US011145979B2

(12) United States Patent
Tehran et al.

(10) Patent No.: US 11,145,979 B2
(45) Date of Patent: Oct. 12, 2021

(54) HIGH GAIN AND LARGE BANDWIDTH ANTENNA INCORPORATING A BUILT-IN DIFFERENTIAL FEEDING SCHEME

(71) Applicant: Samsung Electronics Co., Ltd., Suwon-si (KR)

(72) Inventors: Hamid Reza Memar Zadeh Tehran, Richardson, TX (US); Gary Xu, Allen, TX (US); Won Suk Choi, Plano, TX (US); Jianzhong Zhang, Plano, TX (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/195,401

(22) Filed: Mar. 8, 2021

(65) Prior Publication Data

US 2021/0194127 A1 Jun. 24, 2021

Related U.S. Application Data

(63) Continuation of application No. 16/949,878, filed on Nov. 18, 2020, now Pat. No. 10,944,172, which is a (Continued)

(51) Int. Cl.
*H01Q 21/06* (2006.01)
*H01Q 5/35* (2015.01)
(Continued)

(52) U.S. Cl.
CPC ..... *H01Q 5/35* (2015.01); *H01Q 5/50* (2015.01); *H01Q 9/045* (2013.01); *H01Q 21/065* (2013.01)

(58) Field of Classification Search
CPC ..... H01Q 1/523; H01Q 5/35; H01Q 5/50; H01Q 9/045; H01Q 21/065; H01Q 21/24
(Continued)

(56) References Cited

U.S. PATENT DOCUMENTS 8,830,133 B2 * 9/2014 Weily ..... H01Q 19/10 343/770
2015/0042513 A1 2/2015 Foo
(Continued)

FOREIGN PATENT DOCUMENTS

CN 2916958 Y 6/2007
CN 107528115 A 12/2017
KR 10-2017-0016377 A 2/2017

OTHER PUBLICATIONS

Extended European Search Report dated Aug. 25, 2021 regarding Application No. 19854647.5, 11 pages.

*Primary Examiner* — Tung X Le

(57) ABSTRACT

An antenna and a base station including the antenna. The antenna includes a sub-array that includes first and second unit cells and a feed network. The first and second unit cells comprise first and second patches, respectively, having quadrilateral shapes. The feed network comprises a first transmission line terminating below first corners of the first and second patches, respectively; a second transmission line terminating below third corners of the first and second patches, respectively; a third transmission line terminating below a second corner of the first patch and a fourth corner of the second patch; and a fourth transmission line terminating below a fourth corner of the first patch and a second corner of the second patch. The first corners are opposite the third corners on the respective first and second patches and the second corners are opposite the fourth corners on the respective first and second patches.

20 Claims, 8 Drawing Sheets

Related U.S. Application Data continuation of application No. 16/410,981, filed on May 13, 2019, now Pat. No. 10,931,014.

(60) Provisional application No. 62/724,175, filed on Aug. 29, 2018, provisional application No. 62/732,070, filed on Sep. 17, 2018.

(51) Int. Cl.
*H01Q 5/50* (2015.01)
*H01Q 9/04* (2006.01)

(58) Field of Classification Search
USPC ..... 343/700 MS, 853, 884
See application file for complete search history.

(56) References Cited

U.S. PATENT DOCUMENTS

| | | | | |
|---|---|---|---|---|
| 2015/0381229 | A1 | 12/2015 | Tzanidis et al. | |
| 2017/0244159 | A1 | 8/2017 | Moon et al. | |
| 2017/0310017 | A1 | 10/2017 | Howard | |
| 2018/0054005 | A1* | 2/2018 | Jain | H01Q 5/30 |
| 2019/0267709 | A1* | 8/2019 | Mow | H01Q 3/28 |

* cited by examiner

HIGH GAIN AND LARGE BANDWIDTH ANTENNA INCORPORATING A BUILT-IN DIFFERENTIAL FEEDING SCHEME

CROSS-REFERENCE TO RELATED APPLICATIONS AND CLAIM OF PRIORITY

This application is a continuation of U.S. patent application Ser. No. 16/949,878, filed Nov. 18, 2020, which is a continuation of U.S. patent application Ser. No. 16/410,981, filed May 13, 2019, now U.S. Pat. No. 10,931,014, which claims priority under 35 U.S.C. § 119(e) to U.S. Provisional Patent Application No. 62/724,175 filed Aug. 29, 2018 and U.S. Provisional Patent Application No. 62/732,070 filed Sep. 17, 2018, each of which are incorporated herein by reference in their entireties.

TECHNICAL FIELD

The present disclosure relates generally to an antenna structure. More specifically, the present disclosure relates to an antenna structure that generates a moderate radiated gain over a large frequency range.

BACKGROUND

The concept of Massive Multi-Input Multi-Output (MIMO) is aimed at improving the coverage and spectral efficiency of the next generation of telecommunication systems. In the next generation of telecommunication systems, users are dedicated with one or multiple spatial directions for the intended communication purposes. Massive MIMO-based systems generate multiple beams and form beams subjectively for a user or a group of users in order to increase the desired radiation efficiency. Some Massive MIMO antenna systems have a large number of antenna elements. Therefore, the overall system's performance relies on the performance of individual elements which have a high gain and a reasonably small structure compared to the wavelength at the operating frequency. The operating frequency can range from 2.3-2.6 GHz and/or 3.4-3.6 GHz.

Because of the design frequency and resulting wavelength, difficulties arise in designing an antenna element with a gain of equal or better than ~6 dB and a wideband radiation over a range of 3.2-3.9 GHz while maintaining a simple and cost-effective overall antenna structure that can be mass-produced.

Further, filtering masks in requested by Massive MIMO communication systems are generally realized by an external filter or filters such as cavity or surface acoustic wave filters in order to provide a high roll-off for out-of-band rejection. These filtering masks can result in losses associated with interconnects to the physical point of contacts, soldering, and mechanical restriction. These filtering masks are typically bulky and expensive.

SUMMARY

Embodiments of the present disclosure include an antenna and a base station including an antenna.

In one embodiment, an antenna includes a sub-array. The sub-array includes first and second unit cells and a feed network. The first unit cell includes a first patch. The second unit cell includes a second patch. Each of the first and second patches have a quadrilateral shape. The feed network comprises a first transmission line, a second transmission line, a third transmission line, and a fourth transmission line. The first transmission line terminates below a first corner of the first patch and a first corner of the second patch. The second transmission line terminates below a third corner of the first patch and a third corner of the second patch, wherein the first corners are opposite the third corners on the respective first and second patches. The third transmission line terminates below a second corner of the first patch and a fourth corner of the second patch. The fourth transmission line terminates below a fourth corner of the first patch and a second corner of the second patch, wherein the second corners are opposite the fourth corners on the respective first and second patches.

In another embodiment, a base station includes an antenna including a sub-array. The sub-array includes first and second unit cells and a feed network. The first unit cell includes a first patch. The second unit cell includes a second patch. Each of the first and second patches have a quadrilateral shape. The feed network comprises a first transmission line, a second transmission line, a third transmission line, and a fourth transmission line. The first transmission line terminates below a first corner of the first patch and a first corner of the second patch. The second transmission line terminates below a third corner of the first patch and a third corner of the second patch, wherein the first corners are opposite the third corners on the respective first and second patches. The third transmission line terminates below a second corner of the first patch and a fourth corner of the second patch. The fourth transmission line terminates below a fourth corner of the first patch and a second corner of the second patch, wherein the second corners are opposite the fourth corners on the respective first and second patches.

In another embodiment, an antenna includes a sub-array. The sub-array includes a first unit cell, a second unit cell, a feed network, and a pair of decoupling elements. The first unit comprises a first patch. The second unit cell comprises a second patch. The feed network includes a first transmission line and a second transmission line. The pair of decoupling elements comprises a first decoupling element corresponding to the first transmission line and a second decoupling element corresponding to the second transmission line.

In this disclosure, the terms antenna module, antenna array, beam, and beam steering are frequently used. An antenna module may include one or more arrays. One antenna array may include one or more antenna elements. Each antenna element may be able to provide one or more polarizations, for example vertical polarization, horizontal polarization or both vertical and horizontal polarizations at or around the same time. Vertical and horizontal polarizations at or around the same time can be refracted to an orthogonally polarized antenna. An antenna module radiates the accepted energy in a particular direction with a gain concentration. The radiation of energy in the particular direction is conceptually known as a beam. A beam may be a radiation pattern from one or more antenna elements or one or more antenna arrays.

Other technical features may be readily apparent to one skilled in the art from the following figures, descriptions, and claims.

Before undertaking the DETAILED DESCRIPTION below, it may be advantageous to set forth definitions of certain words and phrases used throughout the present disclosure. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout the present disclosure. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which like reference numerals represent like parts.

DETAILED DESCRIPTION

FIGS. 1 through 6, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged wireless communication system.

To meet the demand for wireless data traffic having increased since deployment of 4G communication systems, efforts have been made to develop an improved 5G or pre-5G communication system. Therefore, the 5G or pre-5G communication system is also called a "beyond 4G network" or a "post LTE system."

The 5G communication system is considered to be implemented in higher frequency (mmWave) bands and sub-6 GHz bands, e.g., 3.5 GHz bands, so as to accomplish higher data rates. To decrease propagation loss of the radio waves and increase the transmission coverage, the beamforming, Massive MIMO, full dimensional MIMO (FD-MIMO), array antenna, an analog beam forming, large scale antenna techniques and the like are discussed in 5G communication systems.

In addition, in 5G communication systems, development for system network improvement is under way based on advanced small cells, cloud radio access networks (RANs), ultra-dense networks, device-to-device (D2D) communication, wireless backhaul communication, moving network, cooperative communication, coordinated multi-points (CoMP) transmission and reception, interference mitigation and cancellation and the like.

Figure 1:
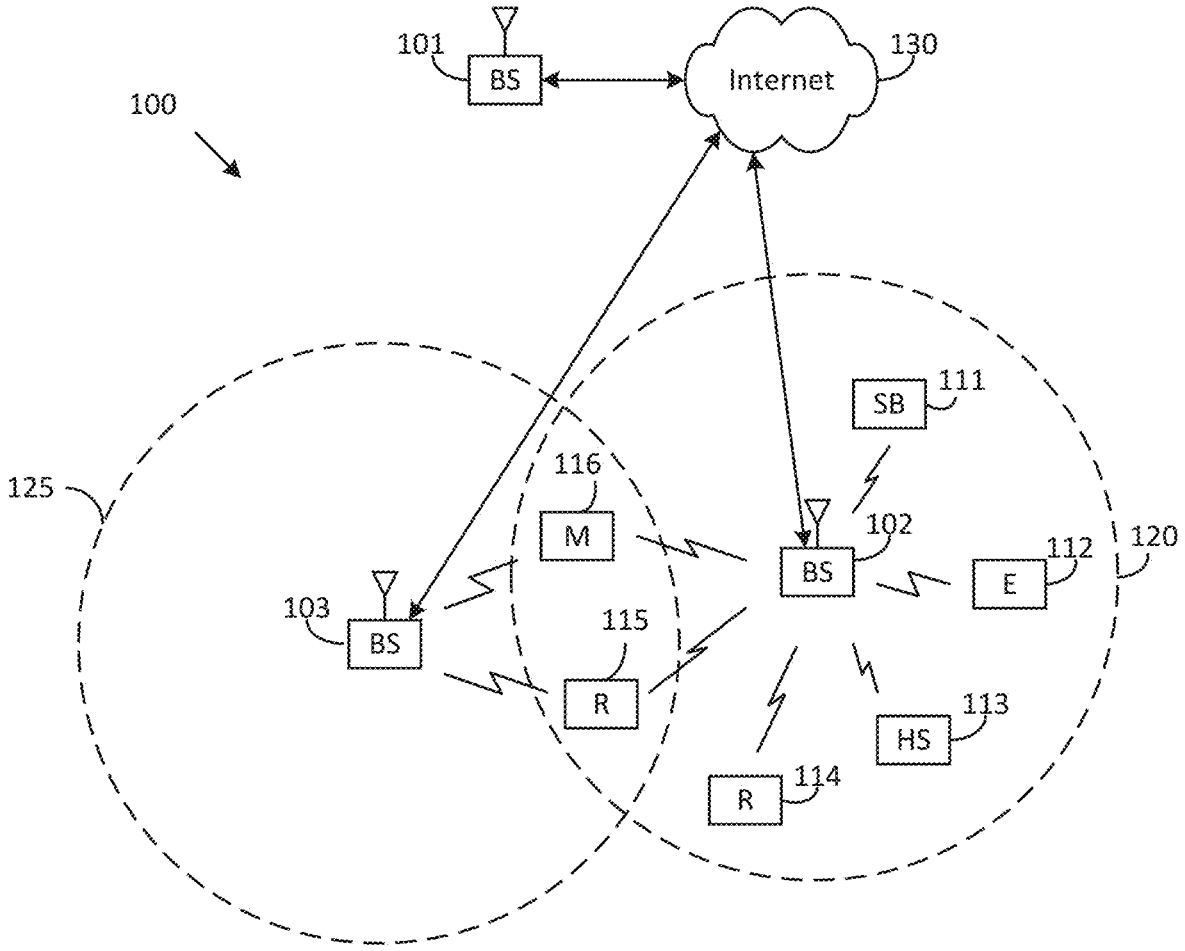
FIG. 1 illustrates a system of a network according to various embodiments of the present disclosure.

FIG. 1 illustrates an example wireless network according to embodiments of the present disclosure. The embodiment of the wireless network shown in FIG. 1 is for illustration only. Other embodiments of the wireless network 100 could be used without departing from the scope of this disclosure.

As shown in FIG. 1, the wireless network 100 includes a gNB 101, a gNB 102, and a gNB 103. The gNB 101 communicates with the gNB 102 and the gNB 103. The gNB 101 also communicates with at least one network 130, such as the Internet, a proprietary Internet Protocol (IP) network, or other data network.

The gNB 102 provides wireless broadband access to the network 130 for a first plurality of UEs within a coverage area 120 of the gNB 102. The first plurality of UEs includes a UE 111, which may be located in a small business (SB); a UE 112, which may be located in an enterprise (E); a UE 113, which may be located in a WiFi hotspot (HS); a UE 114, which may be located in a first residence (R); a UE 115, which may be located in a second residence (R); and a UE 116, which may be a mobile device (M), such as a cell phone, a wireless laptop, a wireless PDA, or the like. The gNB 103 provides wireless broadband access to the network 130 for a second plurality of UEs within a coverage area 125 of the gNB 103. The second plurality of UEs includes the UE 115 and the UE 116. In some embodiments, one or more of the gNBs 101-103 may communicate with each other and with the UEs 111-116 using 5G, LTE, LTE-A, WiMAX, WiFi, or other wireless communication techniques.

Depending on the network type, the term "base station" or "BS" can refer to any component (or collection of components) configured to provide wireless access to a network, such as transmit point (TP), transmit-receive point (TRP), an enhanced base station (eNodeB or gNB), a 5G base station (gNB), a macrocell, a femtocell, a WiFi access point (AP), or other wirelessly enabled devices. Base stations may provide wireless access in accordance with one or more wireless communication protocols, e.g., 5G 3GPP new radio interface/access (NR), long term evolution (LTE), LTE advanced (LTE-A), high speed packet access (HSPA), Wi-Fi 802.11a/b/g/n/ac, etc. For the sake of convenience, the terms "BS" and "TRP" are used interchangeably in the present disclosure to refer to network infrastructure components that provide wireless access to remote terminals. Also, depending on the network type, the term "user equipment" or "UE" can refer to any component such as "mobile station," "subscriber station," "remote terminal," "wireless terminal," "receive point," or "user device." For the sake of convenience, the terms "user equipment" and "UE" are used in the present disclosure to refer to remote wireless equipment that wirelessly accesses a BS, whether the UE is a mobile device (such as a mobile telephone or smartphone) or is normally considered a stationary device (such as a desktop computer or vending machine).

Dotted lines show the approximate extents of the coverage areas 120 and 125, which are shown as approximately circular for the purposes of illustration and explanation only. It should be clearly understood that the coverage areas associated with gNBs, such as the coverage areas 120 and 125, may have other shapes, including irregular shapes, depending upon the configuration of the gNBs and variations in the radio environment associated with natural and man-made obstructions.

Although FIG. 1 illustrates one example of a wireless network, various changes may be made to FIG. 1. For example, the wireless network could include any number of gNBs and any number of UEs in any suitable arrangement. Also, the gNB 101 could communicate directly with any number of UEs and provide those UEs with wireless broadband access to the network 130. Similarly, each gNB 102-103 could communicate directly with the network 130 and provide UEs with direct wireless broadband access to the network 130. Further, the gNBs 101, 102, and/or 103 could provide access to other or additional external networks, such as external telephone networks or other types of data networks.

Figure 2:
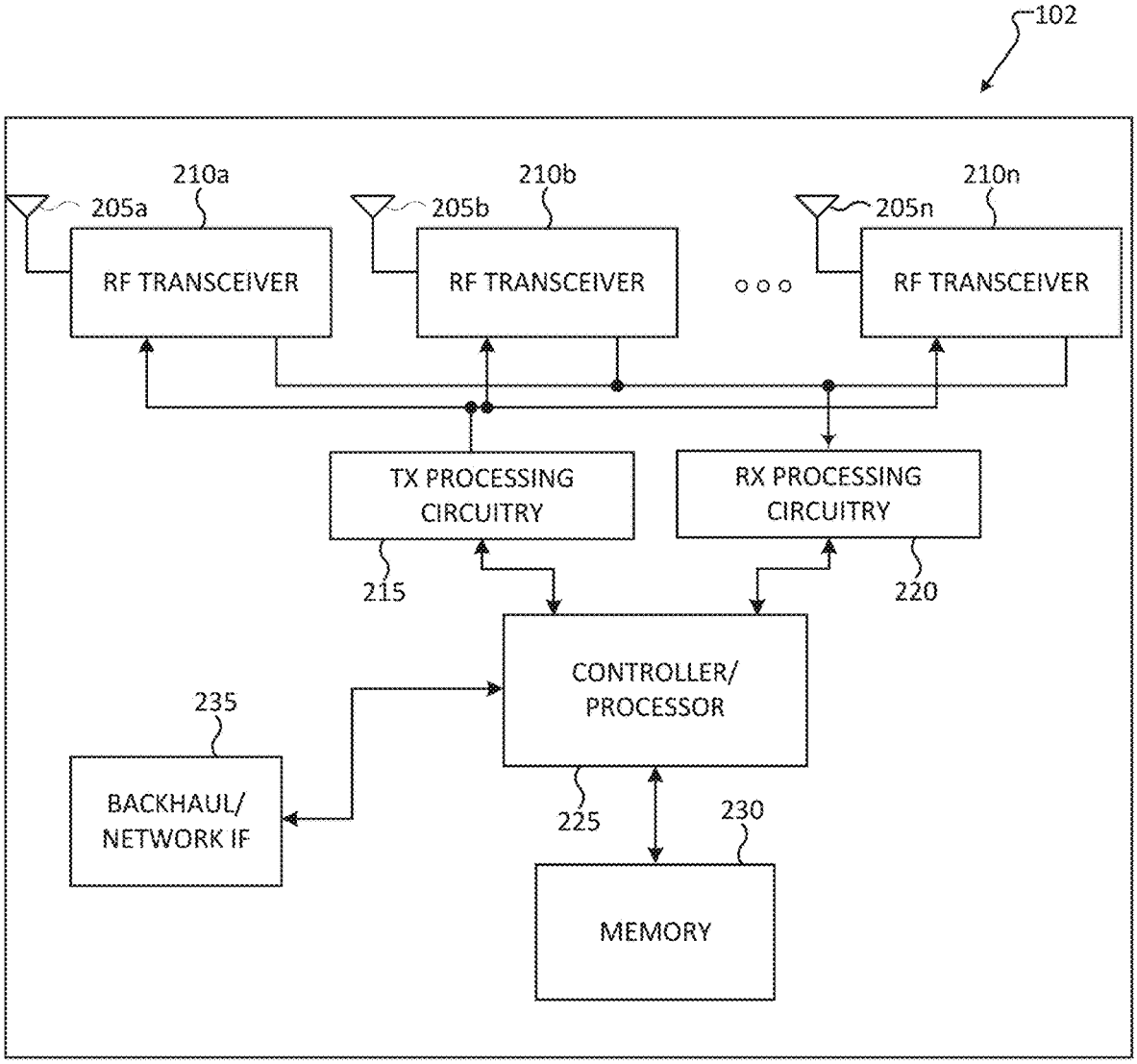
FIG. 2 illustrates a base station according to various embodiments of the present disclosure.

FIG. 2 illustrates an example gNB 102 according to embodiments of the present disclosure. The embodiment of the gNB 102 illustrated in FIG. 2 is for illustration only, and the gNBs 101 and 103 of FIG. 1 could have the same or similar configuration. However, gNBs come in a wide variety of configurations, and FIG. 2 does not limit the scope of this disclosure to any particular implementation of a gNB.

As shown in FIG. 2, the gNB 102 includes multiple antennas 205*a*-205*n*, multiple radiofrequency (RF) transceivers 210*a*-210*n*, transmit (TX) processing circuitry 215, and receive (RX) processing circuitry 220. The gNB 102 also includes a controller/processor 225, a memory 230, and a backhaul or network interface 235. In various embodiments, the antennas 205*a*-205*n* may be a high gain and large bandwidth antenna that may be designed based on a concept of multiple resonance modes and may incorporate a stacked or multiple patch antenna scheme. For example, in various embodiments, each of the multiple antennas 205*a*-205*n* can include one or more antenna panels that includes one or more sub-arrays (e.g., the sub-array 300 illustrated in FIGS. 3A-C or the sub-array 500 illustrated in FIGS. 5A-5C).

The RF transceivers 210*a*-210*n* receive, from the antennas 205*a*-205*n*, incoming RF signals, such as signals transmitted by UEs in the wireless network 100. The RF transceivers 210*a*-210*n* down-convert the incoming RF signals to generate IF or baseband signals. The IF or baseband signals are sent to the RX processing circuitry 220, which generates processed baseband signals by filtering, decoding, and/or digitizing the baseband or IF signals. The RX processing circuitry 220 transmits the processed baseband signals to the controller/processor 225 for further processing.

The TX processing circuitry 215 receives analog or digital data (such as voice data, web data, e-mail, or interactive video game data) from the controller/processor 225. The TX processing circuitry 215 encodes, multiplexes, and/or digitizes the outgoing baseband data to generate processed baseband or IF signals. The RF transceivers 210*a*-210*n* receive the outgoing processed baseband or IF signals from the TX processing circuitry 215 and up-converts the baseband or IF signals to RF signals that are transmitted via the antennas 205*a*-205*n*.

The controller/processor 225 can include one or more processors or other processing devices that control the overall operation of the gNB 102. For example, the controller/processor 225 could control the reception of forward channel signals and the transmission of reverse channel signals by the RF transceivers 210*a*-210*n*, the RX processing circuitry 220, and the TX processing circuitry 215 in accordance with well-known principles. The controller/processor 225 could support additional functions as well, such as more advanced wireless communication functions. For instance, the controller/processor 225 could support beam forming or directional routing operations in which outgoing/incoming signals from/to multiple antennas 205*a*-205*n* are weighted differently to effectively steer the outgoing signals in a desired direction. Any of a wide variety of other functions could be supported in the gNB 102 by the controller/processor 225.

The controller/processor 225 is also capable of executing programs and other processes resident in the memory 230, such as an OS. The controller/processor 225 can move data into or out of the memory 230 as required by an executing process.

The controller/processor 225 is also coupled to the backhaul or network interface 235. The backhaul or network interface 235 allows the gNB 102 to communicate with other devices or systems over a backhaul connection or over a network. The interface 235 could support communications over any suitable wired or wireless connection(s). For example, when the gNB 102 is implemented as part of a cellular communication system (such as one supporting 5G, LTE, or LTE-A), the interface 235 could allow the gNB 102 to communicate with other gNBs over a wired or wireless backhaul connection. When the gNB 102 is implemented as an access point, the interface 235 could allow the gNB 102 to communicate over a wired or wireless local area network or over a wired or wireless connection to a larger network (such as the Internet). The interface 235 includes any suitable structure supporting communications over a wired or wireless connection, such as an Ethernet or RF transceiver.

The memory 230 is coupled to the controller/processor 225. Part of the memory 230 could include a RAM, and another part of the memory 230 could include a Flash memory or other ROM.

Although FIG. 2 illustrates one example of gNB 102, various changes may be made to FIG. 2. For example, the gNB 102 could include any number of each component shown in FIG. 2. As a particular example, an access point could include a number of interfaces 235, and the controller/processor 225 could support routing functions to route data between different network addresses. As another particular example, while shown as including a single instance of TX processing circuitry 215 and a single instance of RX processing circuitry 220, the gNB 102 could include multiple instances of each (such as one per RF transceiver). In addition, various components in FIG. 2 could be combined, further subdivided, or omitted and additional components could be added according to particular needs.

Figure 3A:
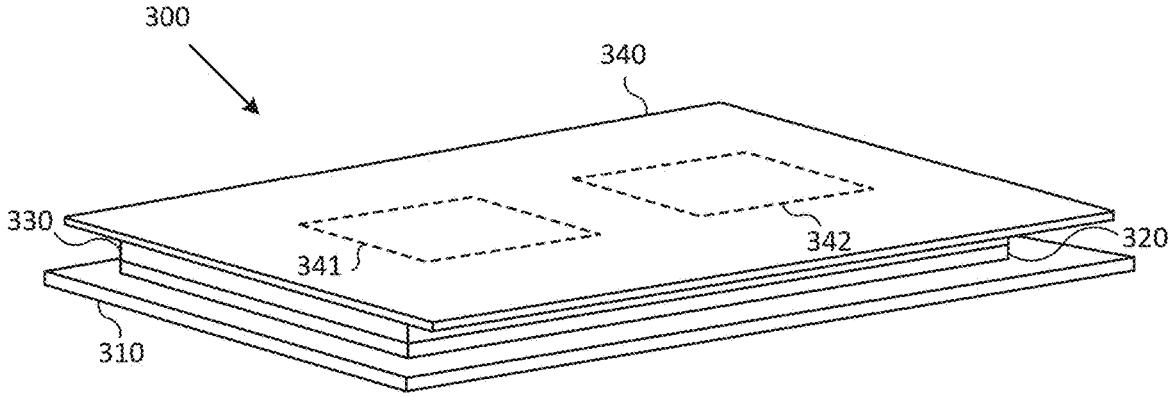
FIG. 3A illustrates a top perspective view of a sub-array according to various embodiments of the present disclosure.
Figure 3B:
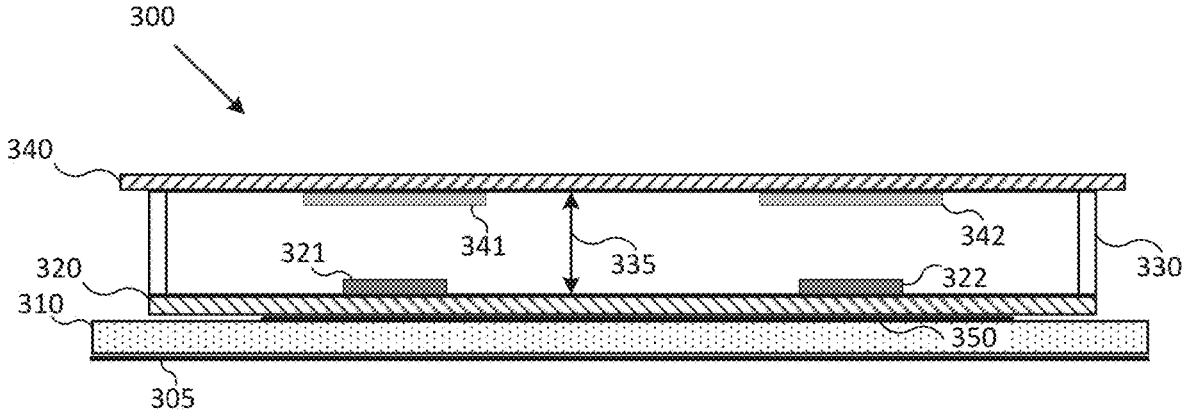
FIG. 3B illustrates a side view of a sub-array according to various embodiments of the present disclosure.
Figure 3C:
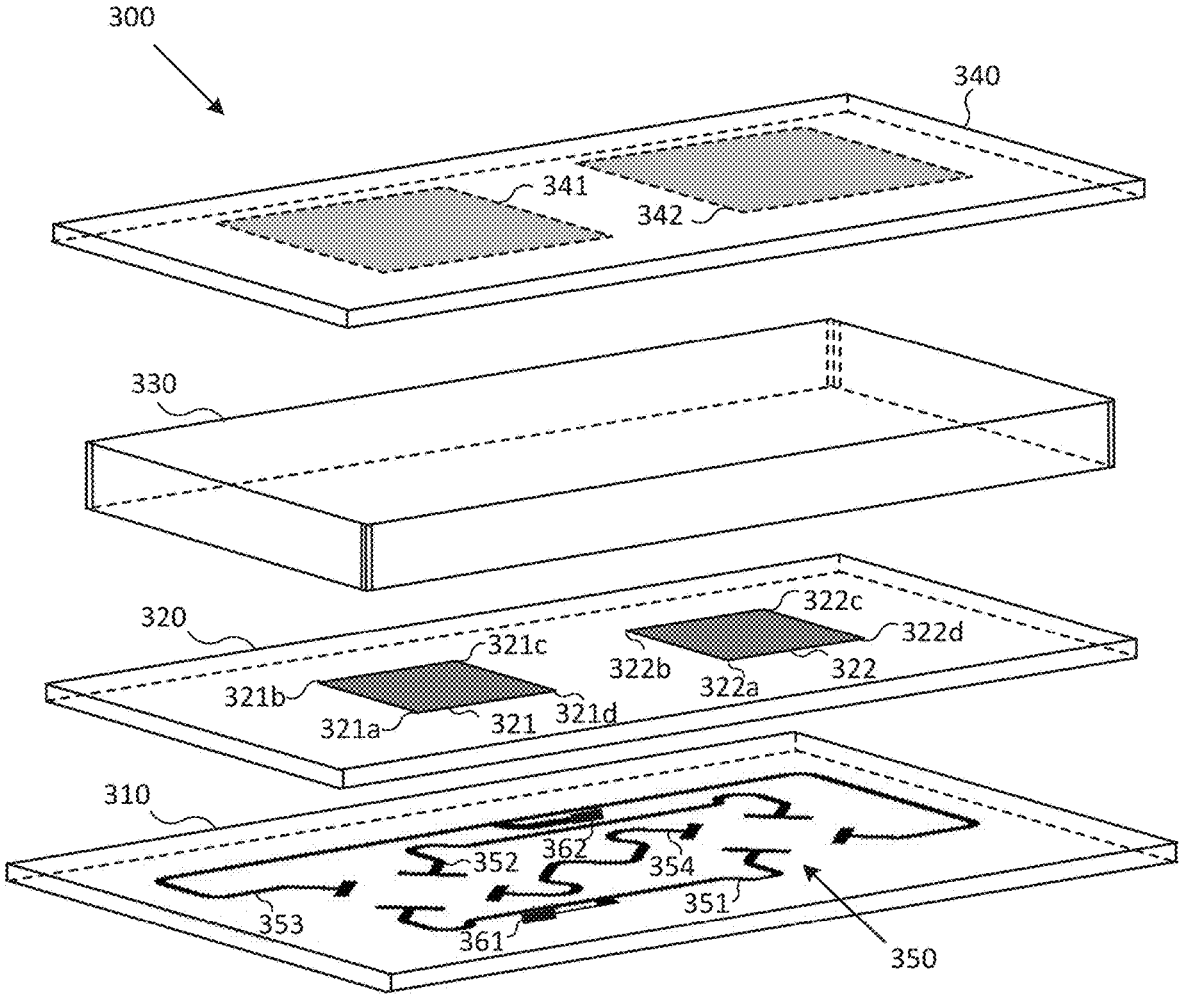
FIG. 3C illustrates an exploded view of a sub-array according to various embodiments of the present disclosure.

FIGS. 3A-3C illustrate a sub-array according to various embodiments of the present disclosure. FIG. 3A illustrates a top perspective view of a sub-array according to various embodiments of the present disclosure. FIG. 3B illustrates a side view of a sub-array according to various embodiments of the present disclosure. FIG. 3C illustrates an exploded view of a sub-array according to various embodiments of the present disclosure.

Figure 4A:
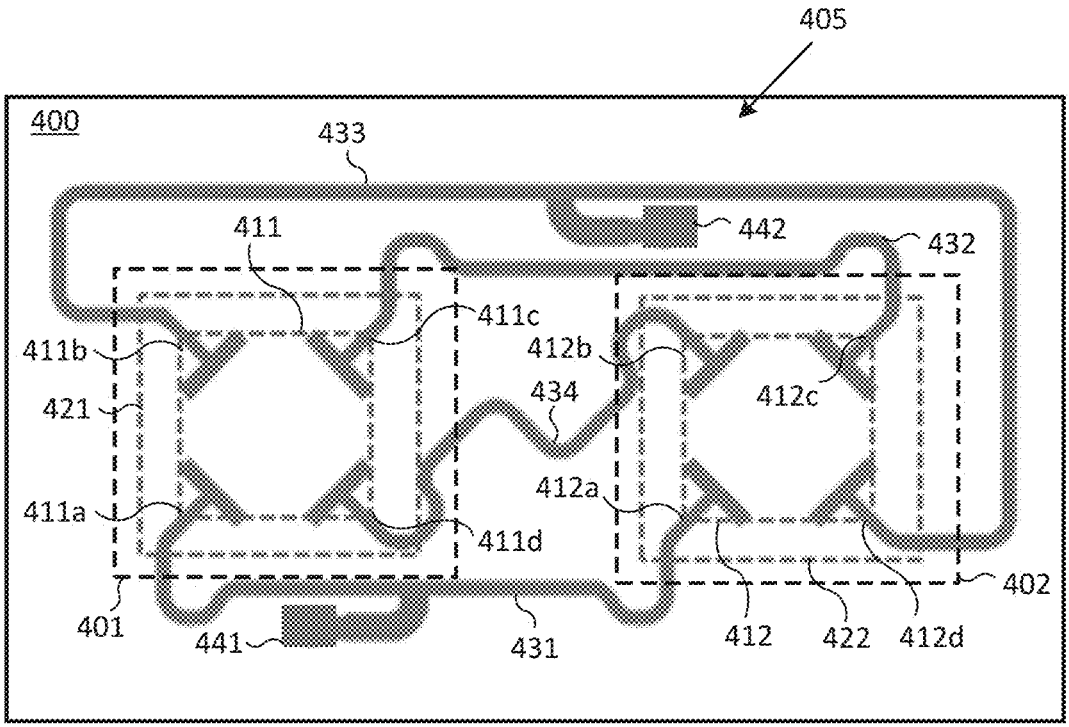
FIGS. 4A-4B illustrate example feed networks according to various embodiments of the present disclosure.
Figure 4B:
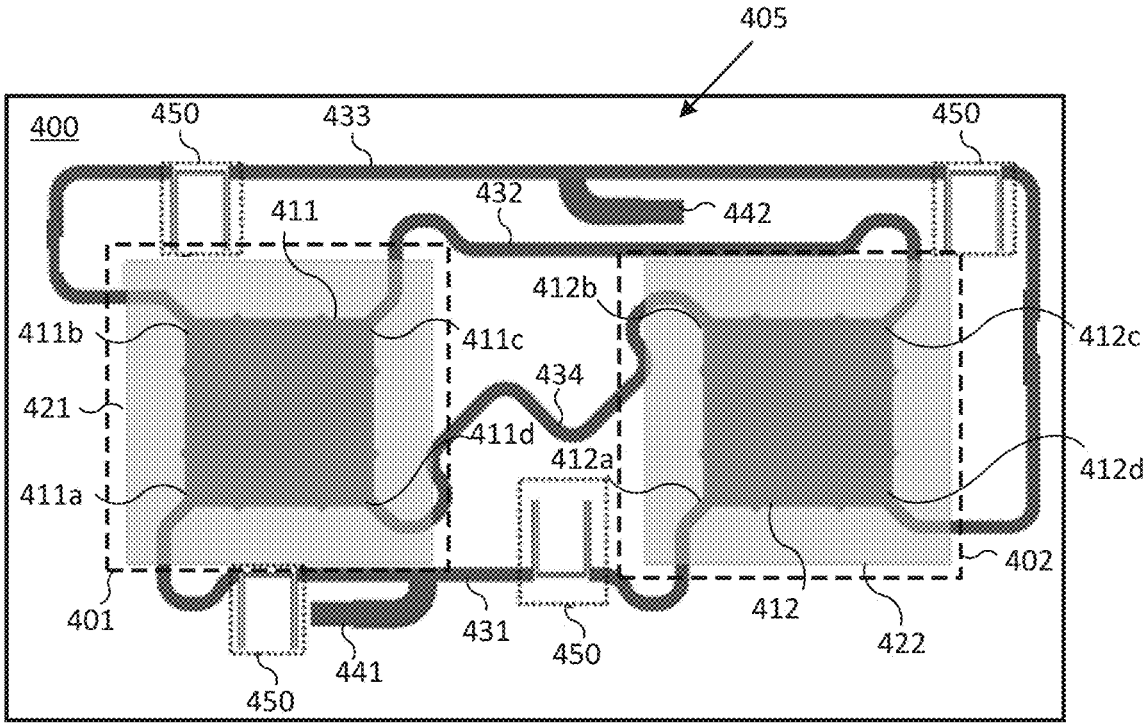

The sub-array 300 includes a first unit cell and a second unit cell (for example, the first unit cell 401 and second unit cell 402 described in FIGS. 4A-4B). The first unit cell includes a first patch 321 and the second unit cell includes a second patch 322. A feed network 350 is provided that feeds each of the first unit cell and the second unit cell. The sub-array 300, including the first unit cell and the second unit cell, comprises a ground plane 305, a first layer 310, a second layer 320, a third layer 330, and a fourth layer 340. The ground plane 305 is comprised of metal and is positioned on the underside of the first layer 310.

The first layer 310 is comprised of a substrate. The first layer 310 includes a feed network 350 positioned on the opposite side of the first layer 310 from the ground plane 305. The feed network 350 transmits power to the first unit cell and the second unit cell of the sub-array 300. The feed network 350 can be a series/corporate feed network. The feed network 350 includes a first transmission line 351, a second transmission line 352, a third transmission line 353, a fourth transmission line 354, a first excitation port 361, and a second excitation port 362. The feed network 350 is configured to correspond to the first patch 321 and the second patch 322 that are provided in the second layer 320.

The second layer 320 is comprised of a substrate. For example, the second layer 320 can be a layer of electromagnetic (EM) or dielectric material. In some embodiments, a space is provided between the first layer 310 and the second layer 320. The space includes the feed network 350 but otherwise is an absence of metallization elements. Although illustrated as an empty space filled with air, the space can include a dielectric material. The second layer 320 includes the first patch 321 and the second patch 322. In some embodiments, the first patch 321 and the second patch 322 are positioned on top of the second layer 320. For example, the first patch 321 and the second patch 322 can be stuck, staked, or grown on the second layer 320. The dielectric material of the second layer 320 allows EM radiation to pass through the dielectric material of the second layer 320 to the hollow cavity of the third layer 330. In other embodiments, when the second layer 320 is an EM material, the first patch 321 and the second patch 322 can comprise a dielectric material that allows EM radiation to pass through the first patch 321 and the second patch 322 to the hollow cavity of the third layer 330.

Each of the first patch 321 and the second patch 322 are provided in a quadrilateral shape and include four corners. For example, the first patch 321 includes a first corner 321*a*, a second corner 321*b*, a third corner 321*c*, and a fourth corner 321*d*. The first corner 321*a* is arranged opposite of the third corner 321*c*. The second corner 321*b* is arranged opposite of the fourth corner 321*d*. This description should not be construed as limiting. In various embodiments, the first patch 321 can be a square, a rectangle, or any other shape where a first corner is opposite a third corner and a second corner is opposite a fourth corner.

The second patch 322 includes a first corner 322*a*, a second corner 322*b*, a third corner 322*c*, and a fourth corner 322*d*. The first corner 322*a* is arranged opposite of the third corner 322*c*. The second corner 322*b* is arranged opposite of the fourth corner 322*d*. This description should not be construed as limiting. In various embodiments, the second patch 322 can be a square, a rectangle, or any other shape where a first corner is opposite a third corner and a second corner is opposite a fourth corner.

The feed network 350 feeds both of the first unit cell and the second unit cell and is configured to correspond to the first patch 321 and the second patch 322 in the second layer 320. For example, the first transmission line 351 includes the first excitation port 361 and terminates below the first corner 321*a* of the first patch 321 and the first corner 322*a* of the second patch 322. The second transmission line 352 terminates below the third corner 321*c* of the first patch 321 and the third corner 322*c* of the second patch 322. The third transmission line 353 includes the second excitation port 362 and terminates below the second corner 321*b* of the first patch 321 and the fourth corner 322*d* of the second patch 322. The fourth transmission line 354 terminates below the fourth corner 321*d* of the first patch 321 and the second corner 322*b* of the second patch 322. Although the term below is used to describe the termination points of the first transmission line, second transmission line, third transmission line, and fourth transmission line, this description is intended to be relative and should not be construed as a limitation on the orientation of the antennas or subarrays discussed herein. The termination point can be modified for perspective and is intended to encompass any position above, around, near, or to the side of any of the respective corners described above. For example, the term terminate below can be used to describe any of the first transmission line, second transmission line, third transmission line, and fourth transmission line terminating more closely to the corner than the center of the respective patch.

The third layer 330 is a hollow cavity formed by an enclosure. The enclosed portion comprises four sides and is open on each end. The openings on each end of the cavity enclosure provide an air gap 335 between the second layer 320 and the fourth layer 340. The air gap 335 allows electromagnetic transmission from the first patch 321 and second patch 322 to flow through the hollow cavity to the fourth layer 340. The third layer 330 improves the isolation and directivity of the sub-array 300.

The fourth layer 340 is comprised of a substrate. For example, the fourth layer 340 can be a layer of EM or dielectric material. The fourth layer 340 includes a third patch 341 and a fourth patch 342. In some embodiments, the third patch 341 and the fourth patch 342 are positioned on the underside of the fourth layer 340 proximate to the hollow cavity of the third layer 330. For example, the third patch 341 and fourth patch 342 can be stuck, staked, or grown on the fourth layer 340. The dielectric material of the fourth layer 340 allows EM radiation to pass through the fourth layer 340 to be radiated by the antenna 205*a*-205*n*. In other embodiments, when the fourth layer 340 is an EM material, the third patch 341 and the fourth patch 342 can comprise a dielectric material that allows EM radiation to pass through the third patch 341 and the fourth patch 342 to be radiated by the antenna 205*a*-205*n*.

The third patch 341 and the fourth patch 342 correspond to the first patch 321 and the second patch 322, respectively, on the second layer 320. The first unit cell includes the first patch 321 and the third patch 341. The second unit cell includes the second patch 322 and the fourth patch 342. Each of the third patch 341 and the fourth patch 342 are larger than each of the first patch 321 and second patch 322, respectively. In other words, the third patch 341 of the first unit cell is larger than the first patch 321 of the first unit cell and the fourth patch 342 of the second unit cell is larger than the second patch 322 of the second unit cell.

In the sub-array 300, the first patch 321 and the second patch 322 are positioned proximate to the feed network 350 and separated from the feed network 350 by the first layer 310. The third patch 341 and the fourth patch 342 are separated from the first patch 321 and the second patch 322 by the air gap 335 provided by the third layer 330. This configuration allows the sub-array 300 to achieve the desired radiation at a high gain and lower cross-polarization rejection ratio.

In some embodiments, one or more sub-arrays 300 can be included in an antenna, for example an antenna 205*a*-205*n*. For example, one or more sub-arrays 300 can be developed into an antenna 205*n* comprising eight sub-arrays 300 arranged in a two by four arrangement while both the sub-array to sub-array and port-to-port isolations are maintained at high levels. In another example, one or more sub-arrays 300 can be developed into an antenna 205*n* comprising sixteen sub-arrays 300 arranged in one by sixteen, two by eight, or four by four arrangements while both the sub-array to sub-array and port-to-port isolations are maintained at high levels. These examples are not intended as limiting, and in some embodiments one or more sub-arrays 300 can be developed into antennas 205*n* comprising one hundred or more sub-arrays 300 while both the sub-array to sub-array and port-to-port isolations are maintained at high levels. In any of the above-examples, the sub-array 300 can propagate fields at the slanted +45 degree and −45 degree polarizations at or around the same time. Embodiments of the present disclosure, for example the embodiments described herein in FIGS. 3A-3C, can radiate orthogonal polarization with an advantageous level of cross-polarization rejection.

In various embodiments, the available area for each sub-array 300 arranged in the antenna 205*a*-205*n* can be less than 10,000 square millimeters. For example, the sub-array 300 arranged in the antenna 205*a*-205*n* can be arranged on a 62.5 mm by 132 mm area. This particular arrangement, when implemented in an antenna 205*a*-205*n*, can be utilized to radiate the field at the highly isolated orthogonal polarizations including slanted +45 degree and −45 degree polarizations as previously described. In some embodiments where sixteen sub-arrays 300 are used to create an antenna 205*a*-205*n*, the sub-arrays 300 can have a spacing of 0.74λ toward the azimuth and a spacing of 1.48λ toward the elevation direction.

FIGS. 4A-4B illustrate example feed networks of a sub-array according to various embodiments of the present disclosure. The sub-array 400 can be the sub-array 300. The feed network 405 can be the feed network 350. The feed network 405 can be a series/corporate feed network.

The feed network 405 can be the feed network 350 illustrated in FIGS. 3A-3C. The feed network 405 is deposited on a substrate. The feed network 405 includes a first transmission line 431, a second transmission line 432, a third transmission line 433, and a fourth transmission line 434. The first transmission line 431 includes a first excitation port 441. The third transmission line 433 includes a second excitation port 442. The first transmission line 431 can be the first transmission line 351, the second transmission line 432 can be the second transmission line 352, the third transmission line 433 can be the third transmission line 353, the fourth transmission line 434 can be the fourth transmission line 354, the first excitation port 441 can be the first excitation port 361, and the second excitation port 442 can be the second excitation port 362.

FIGS. 4A-4B also illustrate a first unit cell 401 and a second unit cell 402. The first unit cell 401 includes a first patch 411 and a third patch 421. The second unit cell 402 includes a second patch 412 and a fourth patch 422. The first patch 411 can be the first patch 321. The second patch 412 can be the second patch 322. The third patch 421 can be the third patch 341. The fourth patch 422 can be the fourth patch 342.

The arrangement of the transmission lines 431-434 provides a differential feeding scheme that reduces cross-polarization of the sub-array 400 and phase-adjustment of both polarizations. For example, the first transmission line 431 is configured to provide a differential feeding scheme for a first polarization that is a +45 degree and −45 degree slanted polarization. The first transmission line 431 feeds the first corner 411*a* of the first patch 411 and the first corner 412*a* of the second patch 412. The third transmission line 433 is configured to provide a differential feeding scheme for a second polarization that is a +45 degree and −45 degree slanted polarization. The third transmission line 433 feeds the second corner 411*b* of the first patch 411 and the fourth corner 412*d* of the second patch 412.

The second transmission line 432 provides phase-adjustment for the first polarization that is fed by the first transmission line 431. The second transmission line 432 feeds the third corner 411*c* of the first patch 411 and the third corner 412*c* of the second patch 412. The fourth transmission line 434 provides phase adjustment for the second polarization that is fed by third transmission line 433. The fourth transmission line 434 feeds the fourth corner 411*d* of the first patch 411 and the second corner 412*b* of the second patch 412.

The transmission lines 431-434 are interconnected by the first patch 411 and the second patch 412. In some embodiments, the feeding mechanism fed to each of the first unit cell 401 and the second unit cell 402 by the first transmission line 431 and the third transmission line 433 can be referred to as diagonal feeding. In some embodiments, the feeding mechanism fed to the sub-array 400 by the transmission lines 431-434 through the first patch 411 and the second patch 412 can be referred to as corner feeding or cross-corner feeding. For example, power can be introduced to the sub-array 400 by the first excitation port 441. From the first excitation port 441, the power is divided in half and fed through the first transmission line 431 to each of the first corner 411*a* of the first patch 411 and the first corner 412*a* of the second patch 412. The power can be divided in half by a power divider (not pictured). The power can be transferred from the first transmission line 431 to the first patch 411 and the second patch 412 by proximity coupling excitation. Proximity coupling excitation allows the power to be transferred to the first patch 411 and the second patch 412 without physical contact. This enables the first transmission line 431 and the first patch 411 and the second patch 412 to be located on different layers of the sub-array 400.

From the first corner 411*a*, the power is fed through the first patch 411 and received by the second transmission line 432 at the third corner 411*c*. The second transmission line 432 adjusts the phase of the power and cycles the power to the third corner 412*c*. The power is then fed through the second patch 412 and received at the first corner 412*a*. At or around the same time, the power introduced by the sub-array 400 is also fed through the first transmission line 431 to the first corner 412*a*. From the first corner 412*a*, the power is fed through the second patch 412 and received by the second transmission line 432 at the third corner 412*c*. The second transmission line 432 adjusts the phase of the power and cycles the power to the third corner 411*c*. The power is then fed through the first patch 411 and received at the first corner 411*a*.

As another example, power can be introduced the sub-array 400 by the second excitation port 442. From the second excitation port 442, the power is divided in half and fed through the third transmission line 433 to each of the second corner 411*b* of the first patch 411 and the fourth corner 412*d* of the second patch 412. The power can be divided in half by a power divider (not pictured). The power can be transferred from the third transmission line 433 to the first patch 411 and the second patch 412 by proximity coupling excitation. From the second corner 411*b*, the power is fed through the first patch 411 and received by the fourth transmission line 434 at the fourth corner 411*d*. The fourth transmission line 434 adjusts the phase of the power and cycles the power to the second corner 412*b*. The power is then fed through the second patch 412 and received at the fourth corner 412*d*. At or around the same time, the power introduced by the sub-array 400 is also fed through the third transmission line 433 to the fourth corner 412*d*. From the fourth corner 412*d*, the power is fed through the second patch 412 and received by the fourth transmission line 434 at the second corner 412*b*. The fourth transmission line 434 adjusts the phase of the power and cycles the power to the fourth corner 411*d*. The power is then fed through the first patch 411 and received at the second corner 411*b*.

In some embodiments, power can be introduced to the sub-array 400 by the first excitation port 441 and the second excitation port 442 at or around the same time, resulting in each corner of the first patch 411 and second patch 412 being fed power that is balanced by equal power from another corner. For example, the power introduced at the first corner 411*a* is balanced by the power introduced at the third corner 411*c*. Similarly, the power introduced at the second corner 411*b* is balanced by the power introduced at the fourth corner 411*d*. In addition, the power introduced at the first corner 411*a* is balanced by the power introduced at the first corner 412*a* and the power introduced at the second corner 411*b* is balanced by the power introduced at the fourth corner 412*d*.

As described above, the second transmission line 432 adjusts the phase of the power as it flows between the first patch 411 and second patch 412. The phase adjusting performed by the second transmission line 432 ensures the power phases at each end of the second transmission line 432 are equal. Similarly, the fourth transmission line 434 adjusts the phase of the power as it flows between the first patch 411 and second patch 412. The phase adjusting performed by the fourth transmission line 434 ensures the power phases at each end of the fourth transmission line 434 are equal. By utilizing two separate transmission lines to adjust the phase between the first unit cell 401 and the second unit cell 402, the radiation pattern of the sub-array 400 and differential feeding of the sub-array 400 between the first unit cell 401 and the second unit cell 402 is stabilized. The differential feeding to the first patch 411 and second patch 412 can be provided by the first transmission line 431 and the third transmission line 433. In addition, the phase adjusting between the first unit cell 401 and second unit cell 402 improves the efficiency of the sub-array 400 and controls the cross-polarization rejection ratio.

In embodiments utilizing the cross-corner feeding described above, each of the first unit cell 401 and second unit cell 402 are differentially excited with weighted excitation to control the side lobe level below 18 dB. In embodiments where the power is introduced to the sub-array 400 by both the first excitation port 441 and the second excitation port 442 at or around the same time, the side lobes can be canceled. By introducing the power through both the first excitation port 441 and the second excitation port 442 at or around the same time and reducing the side lobes level, the efficiency of the overall ratio of gain to physical area is improved. When the sub-array 400 is included in a target array antenna, the target array antenna may not have the optimal spacing between sub-arrays 400 based on the canceled side lobes. This can reduce the system implementation cost at the expense of limited beam steering capability. However, the system implementation cost can be overcome at the system level by algorithms executed by a processor, for example the controller/processor 225, throughout the optimization process.

For example, the sub-array 400 illustrated in FIG. 4A, which includes the isolated first unit cell 401 and second unit cell 402, is differentially excited with weighted excitation to control the side lobe level below 18 dB due to the nature of the feed network 405. The sub-array 400 can exhibit a radiated gain of approximately 11.5 dB while the orthogonal polarization—cross polarization that can exhibit a radiated gain of greater than 20 dB.

Current iterations of Massive MIMO array antennas utilize external filtering masks, such as cavity or surface acoustic wave filters, to provide a high roll-off for out-of-band rejection. The filtering masks are large structures, comparable in size to the antenna itself, that suffer from losses associated with the interconnects to the physical point of contacts, soldering, and mechanical restriction. The losses associated with the interconnects result in a reduced coverage range. Other drawbacks to the filtering masks are emissions and interference from co-designed filters with the antenna radiation. The necessary filtering masks are a significant obstacle to achieving desired efficiency in terms of the generated equivalent isotropically radiated power (ERIP) and the radiated gain. Embodiments of the present disclosure, as illustrated in FIG. 4B, aim to overcome this obstacle by including one or more filtering structures 450 built into the feed network 405 of the sub-array 400.

For example, FIG. 4B illustrates a pair of filtering structures 450 incorporated into each of the first transmission line 431 and the third transmission line 433. Each of the one or more filtering structures 450 can include various filtering structures for a RF network such as SMD filters, commercially off the shelf (COTS) components, parasitic elements, shorting pins, or enclosure cavities to meet the requirements for filtering elements traditionally found on external filters. By incorporating the one or more filtering structures 450 within the feed network 405, it is possible to improve the gain of a sub-array 400 to equal to or better than 11.5 dB, improve the isolation between sub-arrays 400 when multiple sub-arrays 400 are arranged in close proximity in an antenna array, maintain low port-to-port coupling, and provide a design free of external filters that are often bulky and expensive. More specifically, the one or more filtering structures 450 help to prevent out-of-band radiation by associated antenna systems and therefore fully or partially achieve the desired frequency mask(s).

In some embodiments, additional filters can be introduced into the feed network 405. For example, although illustrated in FIG. 4B as including a pair of filtering structures 450 incorporated into each of the first transmission line 431 and the third transmission line 433, some embodiments may include two pairs of filtering structures 450 incorporated into each of the first transmission line 431 and the third transmission line 433. In these embodiments, including additional filtering structures 450 can result in achieving a higher order filtering feature. This description should not be construed as limiting. Any suitable number of filtering structures 450 can be incorporated into any of the first transmission line 431, second transmission line 432, third transmission line 433, and fourth transmission line 434 to achieve the desirable filtering requirements.

Figure 5A:
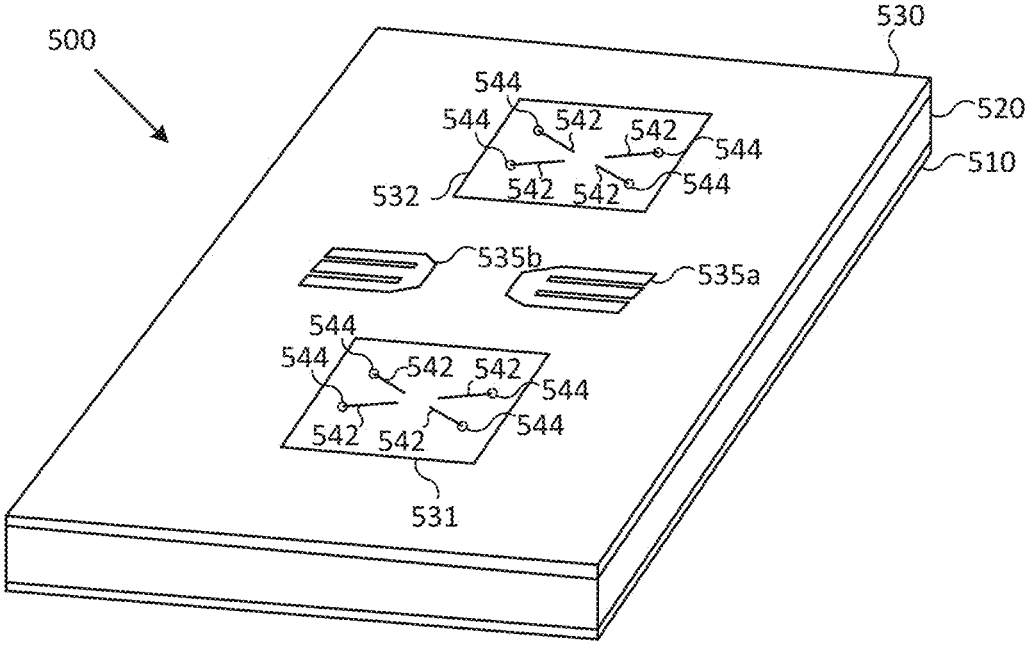
FIG. 5A illustrates a top perspective view of a sub-array according to various embodiments of the present disclosure.
Figure 5B:
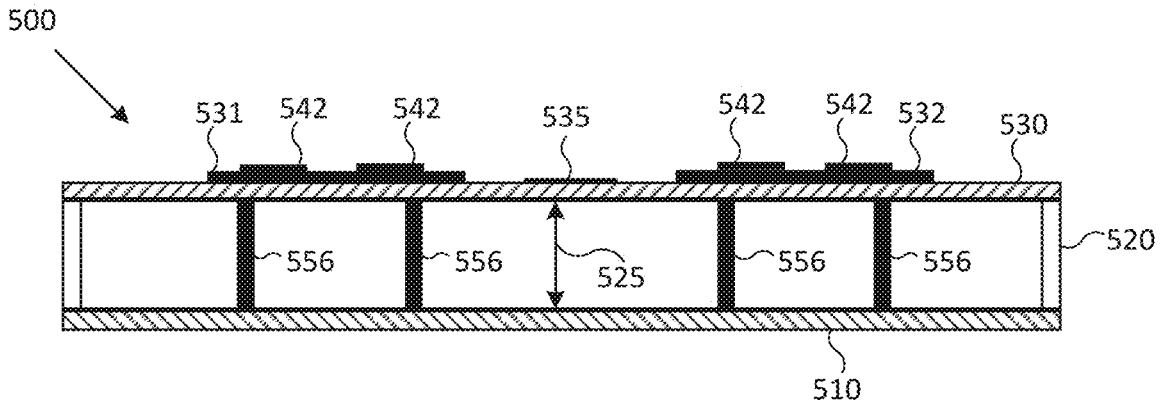
FIG. 5B illustrates a side view of a sub-array according to various embodiments of the present disclosure.
Figure 5C:
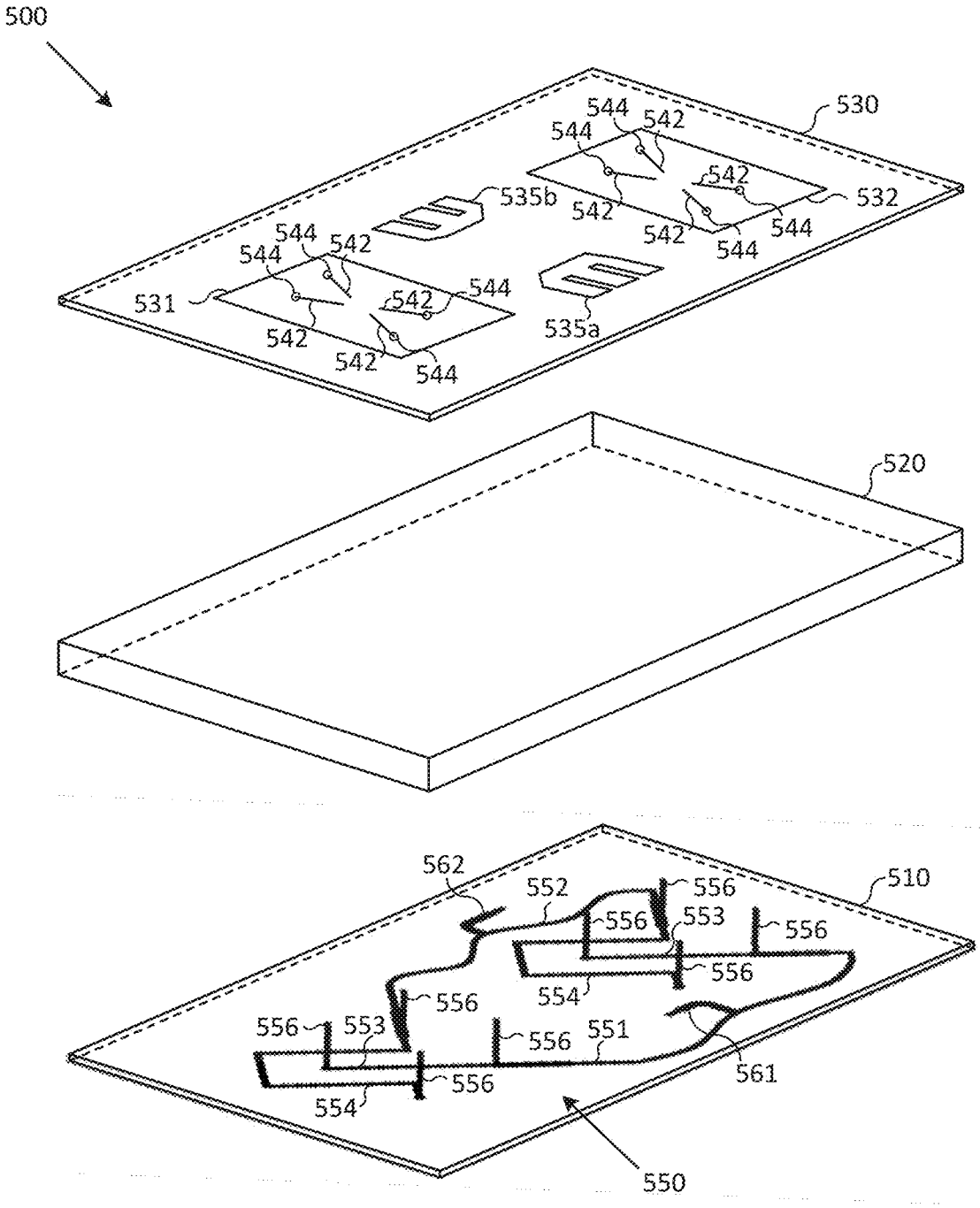
FIG. 5C illustrates an exploded view of a sub-array according to various embodiments of the present disclosure.

FIGS. 5A-5C illustrate a sub-array according to various embodiments of the present disclosure. FIG. 5A illustrates a top perspective view of a sub-array according to various embodiments of the present disclosure. FIG. 5B illustrates a side view of a sub-array according to various embodiments of the present disclosure. FIG. 5C illustrates an exploded view of a sub-array according to various embodiments of the present disclosure.

Figure 6:
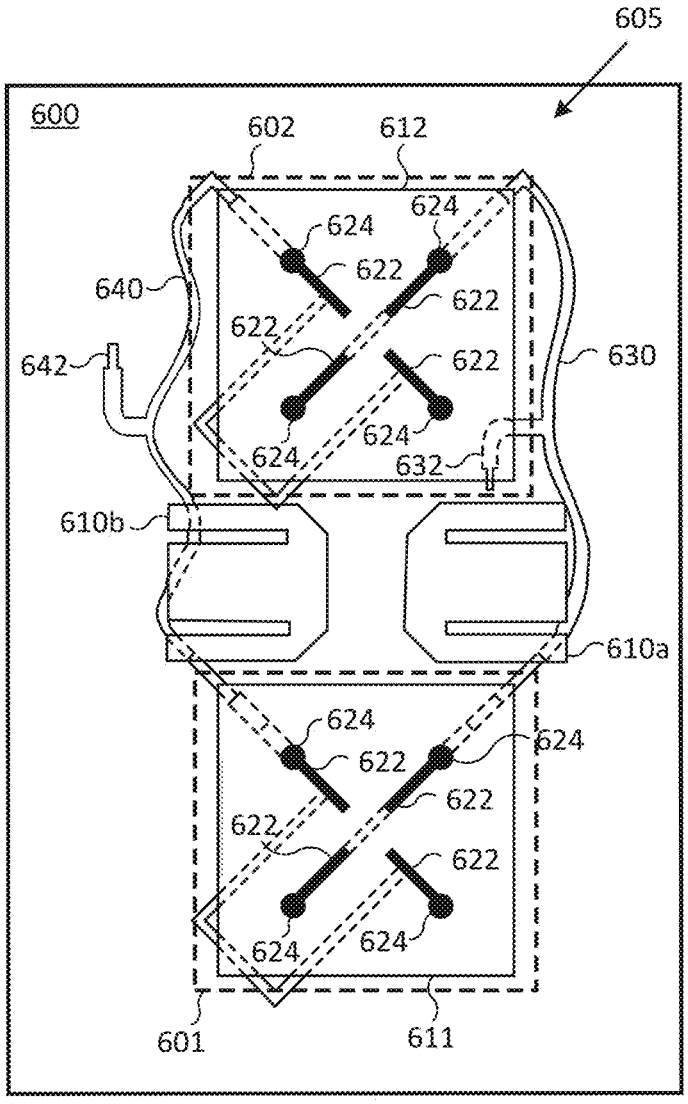
FIG. 6 illustrates an example feed network of a sub-array according to various embodiments of the present disclosure.

The sub-array 500 includes a first unit cell and a second unit cell (for example, the first unit cell 601 and second unit cell 602 described in FIG. 6). The first unit cell includes a first patch 531 and a plurality of vertical feeds 556. The second unit cell includes a second patch 532 and a plurality of vertical feeds 556. The sub-array 500, including the first unit cell and the second unit cell, is arranged in a first layer 510, a second layer 520, and a third layer 530.

The first layer 510 comprises a substrate and includes a feed network 550, a first excitation port 561, and a second excitation port 562. The feed network 550 transmits power to the first unit cell and the second unit cell of the sub-array 500. The feed network 550 can be a series/corporate feed network. The feed network 550 includes a first transmission line 551, a second transmission line 552, phase-shifting portions 553, hybrid couplers 554, and a plurality of vertical feeds 556. The first transmission line 551 is coupled to the first excitation port 561. The second transmission line 552 is coupled to the second excitation port 562.

The second layer 520 is a hollow cavity formed by an enclosure. The enclosed portion comprises four sides but the second layer 520 is open on each end. The openings on each end of the cavity enclosure provide an air gap 525 between the feed network 550 on the first layer 510 and the first patch 531 and the second patch 532 of the third layer 530. The air gap 525 allows electromagnetic transmission to flow through the hollow cavity in the second layer 520. The air gap 525 further provides an enclosed area for the plurality of vertical feeds 556 extending from the feed network 550 on the first layer 510 to connect to the horizontal feeds 542 on the third layer 530.

The third layer 530 is comprised of a substrate. For example, the third layer 530 can be a layer of EM material. The third layer 530 includes decoupling elements 535*a*, 535*b*, the first patch 531, and the second patch 532. The decoupling elements 535*a*, 535*b* are located between the first patch 531 and the second patch 532 to improve the cross-polarization rejection ratio. The decoupling element 535*a* performs a decoupling function on the first transmission line 551 and the decoupling element 535*b* performs a decoupling function on the second transmission line 552.

In some embodiments, the first patch 531 and the second patch 532 can comprise a dielectric material. The dielectric material of the first patch 531 and the second patch 532 allows EM radiation to pass through to the EM material to be radiated by the antenna 205*a*-205*n*. Each of the first patch 531 and the second patch 532 includes horizontal feeds 542 and openings 544. Each of the openings 544 corresponds to both a horizontal feed 542 and a vertical feed 556. For example, each of the openings 544 are configured to allow one of the plurality of vertical feeds 556 to pass through the third layer 530 and couple to a horizontal feed 542.

The first transmission line 551 and second transmission line 552 transfer power through the sub-array 500. In one embodiment, power can be introduced to the sub-array 500 by one or both of the first excitation port 561 and the second excitation port 562. From the first excitation port 561, the power is divided in half and fed through the first transmission line 551 to vertical feeds 556 of both the first unit cell and the second unit cell. The power can be divided in half by a power divider (not pictured). For example, as illustrated in FIG. 5C, the first transmission line 551 feeds two vertical feeds 556 that correspond to the first patch 531 and two vertical feeds 556 that correspond to the second patch 532.

From the second excitation port 562, the power divided in half and is fed through the second transmission line 552 to vertical feeds 556 of both the first unit cell and the second unit cell. The power can be divided in half by a power divider (not pictured). For example, as illustrated in FIG. 5C, the second transmission line 552 feeds two vertical feeds 556 that correspond to the first patch 531 and two vertical feeds 556 that correspond to the second patch 532. The second transmission line 552 forms a built-in 180 degree hybrid coupler.

The vertical feeds 556 transfer the power, which is received from the first excitation port 561 and the second excitation port 562 and fed through the first transmission line 551 and second transmission line 552, through the hollow cavity formed by the second layer 520. The vertical feeds 556 pass through the openings 544 and transfer the power to the horizontal feeds 542 coupled to the vertical feeds 556, respectively. The horizontal feeds 542 transfer the power from a perimeter of the first patch 531 and the second patch 532 toward the interior of each of the first patch 531 and the second patch 532, respectively, where the horizontal feeds 542 terminate. From the termination point, the power can be radiated from the sub-array 500 in the form of a transmission.

The decoupling elements 535*a*, 535*b* assist in isolating the radiation from the sub-array 500 by reducing the coupling between the first patch 531 and the second patch 532. In combination, the functions of the decoupling elements 535*a*, 535*b* isolate the resulting radiation and improve the cross-polarization rejection ratio of the sub-array 500 to reduce or cancel the side lobes of the radiation.

Several advantages can be obtained in antennas, for example antennas 205*a*-205*n*, that utilize the design described in FIGS. 5A-5C. For example, the radiated gain can be measured at greater than 11.5 dB. A cross-polarization rejection ratio can be measured at greater than 18 dB. A return loss can be measured at greater than 20 dB.

Port-to-port isolation of the sub-array 500 can be measured at greater than 20 dB. In-plane can be measured at better than 25 dB. Cross-coupling can be measured at better than 30 dB. Bandwidth can be measured at 200 MHz.

FIG. 6 illustrates an example feed network of a sub-array according to various embodiments of the present disclosure. The sub-array 600 can be the sub-array 500 described in FIGS. 5A-5C. The feed network 605 can be the feed network 550 described in FIGS. 5A-5C.

As illustrated in FIG. 6, the sub-array 600 includes the feed network 605, decoupling elements 610*a*, 610*b*, a first unit cell 601, and a second unit cell 602. The first unit cell 601 includes a first patch 611, horizontal feeds 622, a plurality of openings 624, and a plurality of vertical feeds (not pictured, for example the vertical feeds 556 illustrated in FIGS. 5A-5C). The second unit cell 602 includes a second patch 612, horizontal feeds 622, a plurality of openings 624, and a plurality of vertical feeds (not pictured, for example the vertical feeds 556 illustrated in FIGS. 5A-5C). The decoupling elements 610*a*, 610*b* can be the decoupling elements 535*a*, 535*b*. The first patch 611 can be the first patch 531. The second patch 612 can be the second patch 532.

The feed network 605 includes a first transmission line 630, a first excitation port 632, a second transmission line 640, a second excitation port 642, horizontal feeds 622, a plurality of vertical feeds (not pictured), and a plurality of openings 624. The first transmission line 630 can be the first transmission line 551. The second transmission line 640 can be the second transmission line 552. The horizontal feeds 622 can be the horizontal feeds 542. The plurality of vertical feeds can be the plurality of vertical feeds 556. The plurality of openings 624 can be the plurality of openings 544. The first excitation port 632 can be the first excitation port 561. The second excitation port 642 can be the second excitation port 562.

FIG. 6 illustrates the relationship between the feed network 605, decoupling elements 610*a*, 610*b*, first unit cell 601, and second unit cell 602. More specifically, FIG. 6 illustrates that the termination points of the first transmission line 630 and the second transmission line 640 correspond to the openings 624 to connect the first transmission line 630 and the second transmission line 640 with the horizontal feeds 622 via the plurality of vertical feeds (not pictured). FIG. 6 further illustrates that the decoupling element 610*a* is arranged to correspond to the first transmission line 630 and that the decoupling element 610*b* is arranged to correspond to the second transmission line 640. This arrangement allows the decoupling element 610*a* to perform a decoupling function on the first transmission line 630 and the decoupling element 610*b* to perform an equivalent decoupling function on the second transmission line 640. The decoupling functions performed by the decoupling elements 610*a*, 610*b* can combine to isolate the resulting radiation and improve the cross-polarization rejection ratio of the sub-array 600. In some embodiments, the decoupling elements 610*a*, 610*b* can reduce or cancel the side lobes of the radiation from the sub-array 600.

In some embodiments, the gradual progression of the phase of the electromagnetic waves is the result of the progression of a phase shift in the feed networks of the antenna panel. For example, the beam can be steered by manipulating the cross-polarization of the feed networks by using the RF currents received through the excitation ports.

This disclosure should not be construed as limiting. Various embodiments are possible.

In some embodiments, the feed network is configured to provide cross-corner feeding to the sub-array.

In some embodiments, the first and third transmission lines are configured to provide a cross-polarization of the first unit cell and the second unit cell via the cross-corner feeding. In some embodiments, the cross-polarization includes a difference of +45 and −45 degrees.

In some embodiments, the feed network further comprises a filter provided on at least one of the first transmission line, second transmission line, third transmission line, or fourth transmission line.

In some embodiments, the first transmission line results in a first polarization of the sub-array and the third transmission line results in a second polarization of the sub-array, the first transmission line and the third transmission line provide cross-polarization of the sub-array, the second transmission line is configured to provide phase-adjusting for the second polarization; and the fourth transmission line is configured to provide phase-adjusting for the first polarization.

In some embodiments, the sub-array further comprises a first layer including the feed network, a second layer including the first patch and the second patch, a third layer comprising a hollow cavity formed by an enclosure, and a fourth layer including a third patch and a fourth patch.

In some embodiments, the first unit cell further comprises the third patch, the second unit further comprises the fourth patch, the third patch is larger than the first patch, and the fourth patch is larger than the second patch.

In some embodiments, the third patch is located directly above the first patch and the fourth patch is located directly above the second patch.

In some embodiments, the hollow cavity provides an air gap between (i) the first patch and the third patch, and (ii) the second patch and the fourth patch.

In some embodiments, the feed network is configured to provide differential feeding to the sub-array.

None of the description in this application should be read as implying that any particular element, step, or function is an essential element that must be included in the claim scope. Moreover, none of the claims is intended to invoke 35 U.S.C. § 112(f) unless the exact words "means for" are followed by a participle.

What is claimed is:

1. A base station, comprising:

an radio frequency (RF) transceiver configured to provide RF signals to be transmitted; and an antenna array configured to radiate the RF signals, the antenna array comprising a sub-array, wherein the sub-array comprises:

a first transmission line, a second transmission line;

vertical feeds;

a first antenna element that includes horizontal feeds; and a second antenna element that includes horizontal feeds, wherein the first transmission line and the second transmission line are connected with the horizontal feeds of the first antenna element and of the second antenna element via the vertical feeds, wherein the first transmission line feeds two vertical feeds that correspond to the first antenna element and feeds two vertical feeds that correspond to the second antenna element, and wherein the second transmission line feeds two vertical feeds that correspond to the first antenna element and feeds two vertical feeds that correspond to the second antenna element.

2. The base station of claim 1, wherein the antenna array further includes decoupling elements for the first and second antenna elements, the decoupling elements configured to modify a cross-polarization rejection ratio.

3. The base station of claim 1, wherein the first transmission line includes phase-shifting portions.

4. The base station of claim 1, wherein the second transmission line includes hybrid couplers.

5. The base station of claim 4, wherein the hybrid couplers are built-in 180 degree hybrid couplers of the second transmission line.

6. The base station of claim 1, wherein:

the first transmission line is coupled to a first excitation port, and the second transmission line is coupled to a second excitation port.

7. The base station of claim 6, wherein power can be introduced to the sub-array by at least one of the first excitation port or the second excitation port for transmitting the RF signals.

8. The base station of claim 7, wherein the first antenna element and the second antenna element are configured to provide more than one polarization.

9. The base station of claim 1, wherein the antenna array is an orthogonally polarized antenna.

10. The base station of claim 1, wherein the antenna array is a Massive Multiple Input Multiple Output (MIMO) antenna system.

11. The base station of claim 1, wherein an operating frequency of the antenna array is in a sub-6 GHz band.

12. The base station of claim 1, wherein an operating frequency of the antenna array is in a range of 3.2-3.9 GHz.

13. The base station of claim 1, wherein the base station is configured to provide wireless access to a network using 5G, LTE, LTE-A, WiMAX or WiFi communication protocols.

14. The base station of claim 1, wherein:

the first transmission line and the second transmission line are arranged in a first layer as part of a feed network, and an air gap is provided between the feed network on the first layer and the first and second antenna elements.

15. The base station of claim 1, wherein the two vertical feeds that are fed by the first transmission line and are connected to the first antenna element are a first vertical feed and a third vertical feed of the first antenna element, and the two vertical feeds that are fed by the first transmission line and are connected to the second antenna element are a first vertical feed and a third vertical feed of the second antenna element, wherein the two vertical feeds that are fed by the second transmission line and are connected to the first antenna element are a second vertical feed and a fourth vertical feed of the first antenna element, and the two vertical feeds that are fed by the second transmission line and are connected to the second antenna element are a second vertical feed and a fourth vertical feed of the second antenna element, wherein the horizontal feeds of the first antenna element are a first horizontal feed, a second horizontal feed, a third horizontal feed, and a fourth horizontal feed, wherein the first vertical feed of the first antenna element is connected to the first horizontal feed of the first antenna element, the second vertical feed of the first antenna element is connected to the second horizontal feed of the first antenna element, the third vertical feed of the first antenna element is connected to the third horizontal feed of the first antenna element, the fourth vertical feed of the first antenna element is connected to the fourth horizontal feed of the first antenna element, and wherein the horizontal feeds of the second antenna element are a first horizontal feed, a second horizontal feed, a third horizontal feed, and a fourth horizontal feed, wherein the first vertical feed of the second antenna element is connected to the first horizontal feed of the second antenna element, the second vertical feed of the second antenna element is connected to the second horizontal feed of the second antenna element, the third vertical feed of the second antenna element is connected to the third horizontal feed of the second antenna element, and the fourth vertical feed of the second antenna element is connected to the fourth horizontal feed of the second antenna element.

16. The base station of claim 15, wherein each of the first antenna element and the second antenna element is provided in a quadrilateral shape and includes a first corner arranged opposite a third corner and a second corner arranged opposite a fourth corner, wherein the first vertical feed and third vertical feed of the first antenna element are associated with the first corner and the third corner of the first antenna element, and the second vertical feed and the fourth vertical feed of the first antenna element are associated with the second corner and the fourth corner of the first antenna element, and wherein the first vertical feed and third vertical feed of the second antenna element are associated with the first corner and the third corner of the second antenna element, and the second vertical feed and the fourth vertical feed of the second antenna element are associated with the second corner and the fourth corner of the second antenna element.

17. The base station of claim 15, wherein power fed through the first transmission line is transferred through the first vertical feed and the third vertical feed of the first antenna element to the first horizontal feed and the third horizontal feed of the first antenna element, and is transferred through the first vertical feed and the third vertical feed of the second antenna element to the first horizontal feed and the third horizontal feed of the second antenna element, and wherein power fed through the second transmission line is transferred through the second vertical feed and the fourth vertical feed of the first antenna element to the second horizontal feed and the fourth horizontal feed of the first antenna element, and is transferred through the second vertical feed and the fourth vertical feed of the second antenna element to the second horizontal feed and the fourth horizontal feed of the second antenna element.

18. The base station of claim 17, wherein:

the power fed through the first transmission line via the first and third vertical feeds of the first and second antenna elements to the first and third horizontal feeds of the first and second antenna elements results in a first polarization provided by the first antenna element and the second antenna element, and the power fed through the second transmission line via the second and fourth vertical feeds of the first and second antenna elements to the second and fourth horizontal feeds of the first and second antenna elements results in a second polarization provided by the first antenna element and the second antenna element.

19. The base station of claim 18, wherein the first polarization is orthogonal to the second polarization.

20. The base station of claim 17, wherein the RF transceiver is configured to provide the power fed through the first transmission line and the power fed through the second transmission line.

* * * * *